US009288864B2

(12) United States Patent
Wang et al.

(10) Patent No.: US 9,288,864 B2
(45) Date of Patent: Mar. 15, 2016

(54) ADAPTIVE HOLDING CURRENT CONTROL FOR LED DIMMER

(71) Applicant: Dialog Semiconductor Inc., Campbell, CA (US)

(72) Inventors: Xiaoyan Wang, Milpitas, CA (US); Chenglong Zhang, Campbell, CA (US); Guang Feng, Cupertino, CA (US); Clarita Knoll, San Leandro, CA (US); Chuanyang Wang, San Jose, CA (US); Jiang Chen, Cupertino, CA (US); Liang Yan, Milpitas, CA (US); Dickson T. Wong, Burlingame, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 81 days.

(21) Appl. No.: 14/099,986

(22) Filed: Dec. 8, 2013

(65) Prior Publication Data

US 2014/0159616 A1 Jun. 12, 2014

Related U.S. Application Data

(60) Provisional application No. 61/735,484, filed on Dec. 10, 2012.

(51) Int. Cl.
*H05B 37/02* (2006.01)
*H05B 33/08* (2006.01)

(52) U.S. Cl.
CPC ..... *H05B 33/0848* (2013.01); *H05B 33/0845* (2013.01)

(58) Field of Classification Search
CPC ..... H05B 37/00; H05B 37/02
See application file for complete search history.

(56) References Cited

U.S. PATENT DOCUMENTS 7,936,132 B2 5/2011 Quek et al.
8,111,017 B2 * 2/2012 Lin et al. ..... 315/307

(Continued)

FOREIGN PATENT DOCUMENTS

CN 102573209 A 7/2012
CN 102625514 A 8/2012

(Continued)

OTHER PUBLICATIONS

Chinese First Office Action, Chinese Application No. 2013106710118, May 22, 2015, 15 pages.

(Continued)

*Primary Examiner* — Hai L Nguyen
(74) *Attorney, Agent, or Firm* — Fenwick & West LLP

(57) ABSTRACT

A TRIAC dimmer controller for an LED lamp dynamically adjusts the amount of additional current supplied to the TRIAC dimmer based on the TRIAC dimmer operating mode. A TRIAC dimmer current controller continually senses the TRIAC dimmer current loading and determines a TRIAC dimmer operating mode based on the detected current. The TRIAC dimmer controller compares the detected current with a threshold current value called a TRIAC holding current, and adjusts the amount of bleeder current based on the difference between the detected current and the threshold current value. By continually sensing the TRIAC dimmer current loading, the LED controller regulates the amount of bleeder current supplied to the TRIAC dimmer using a single sink current path to satisfy the TRIAC dimmer current demands of multiple TRIAC dimmer operating modes.

22 Claims, 5 Drawing Sheets

(56) References Cited

U.S. PATENT DOCUMENTS

| | | | | |
|---|---|---|---|---|
| 8,610,375 | B2 * | 12/2013 | Chang et al. | 315/307 |
| 2012/0104970 | A1 | 5/2012 | Okubo et al. | |
| 2012/0188794 | A1 | 7/2012 | Chang et al. | |

FOREIGN PATENT DOCUMENTS

| | | | |
|---|---|---|---|
| EP | 2482439 | A2 | 8/2012 |
| JP | 2011-3467 | A | 1/2011 |
| JP | 2011-108018 | A | 6/2011 |
| JP | 2011-124163 | A | 6/2011 |
| JP | 2012-178310 | A | 9/2012 |
| WO | WO 2011/114261 | A1 | 9/2011 |

OTHER PUBLICATIONS

European Extended Search Report, European Application No. 13196476.9, May 22, 2014, 7 pages.

Japanese Office Action, Japanese Application No. 2013-254956, Sep. 16, 2014, 9 pages.

* cited by examiner

ADAPTIVE HOLDING CURRENT CONTROL FOR LED DIMMER

CROSS-REFERENCE TO RELATED APPLICATIONS

This application claims priority under 35 U.S.C. §119(e) from U.S. Provisional Application No. 61/735,484, filed on Dec. 10, 2012, which is incorporated by reference herein in its entirety.

BACKGROUND

1. Technical Field

The present disclosure relates to driving LED (Light-Emitting Diode) lamps and, more specifically, to adaptively dimming the LED lamps.

2. Description of the Related Arts

A wide variety of electronics applications now use LED lamps. These applications include architectural lighting, automotive head and tail lights, backlights for liquid crystal display devices, flashlights, and electronic signs. Compared to conventional lighting sources, like incandescent lamps and fluorescent lamps, LED lamps have significant advantages. These advantages include high efficiency, good directionality, color stability, high reliability, long life time, small size, and environmental safety. In fact, these advantages have helped drive the adoption of LED lamps in applications that traditionally use incandescent lamps.

In some applications, however, LED lamps have not been adopted as being suitable replacements compared to other lighting methods. For example, in applications where the brightness of the light source is adjusted, such as in a dimmable lighting system, methods employed to drive an incandescent lamp, if applied to an LED lamp, may cause the LED lamp to prematurely turn off when the LED lamp is in an ON phase, resulting in a perceivable flicker. Techniques employed to reduce flicker include adding multiple sink current paths to a TRIAC dimmer to provide additional current to the dimmer to reduce flicker and meet the TRIAC dimmer turn-on current demands. But these techniques increase power loss and lack the ability to adapt to changes in system operating conditions.

SUMMARY

TRIAC dimmers may be used to adjust the brightness of an LED lamp. To turn on (i.e., trigger), a TRIAC dimmer uses about 100-200 mA to keep the TRIAC dimmer in conduction during the triggering operating mode. Once triggered, the TRIAC dimmer enters into another operating mode called the TRIAC conduction operating mode, where the TRIAC dimmer continues to conduct until the current conducted by the TRIAC dimmer drops below a threshold current level (e.g., 5-20 mA). During TRIAC conduction operating mode, if the conduction current drops below the threshold current level, the TRIAC dimmer will turn off, resulting in a perceivable flicker in the LED lamp. To supply the current demands of the TRIAC dimmer during the triggering operating mode and to maintain TRIAC dimmer conduction after the TRIAC dimmer is triggered, the disclosed LED controller employs a single sink current path to adaptively provide current to the TRIAC dimmer based on the operating conditions of the LED lamp system. The disclosed embodiments dynamically adjust the amount of additional current (i.e., bleeder current) supplied to the TRIAC dimmer based on the TRIAC dimmer operating mode. A TRIAC dimmer current controller continually senses the TRIAC dimmer current loading, determines a TRIAC dimmer operating mode based on the detected current, compares the detected current with a threshold current value called a TRIAC holding current, and adjusts the amount of bleeder current based on the difference between the detected current and the threshold current value. By continually sensing the TRIAC dimmer current loading, the LED controller regulates the amount of bleeder current supplied to the TRIAC dimmer through the sink path in accordance with the TRIAC dimmer operating mode.

During the triggering operating mode, the TRIAC dimmer current loading is greater than the TRIAC holding current, and the controller outputs a control signal to turn off the bleeder current. After the triggering operating mode, the controller regulates the bleeder current to supply the threshold current level used to maintain TRIAC dimmer conduction. When the LED lamp current is sufficient to maintain TRIAC dimmer conduction, the disclosed LED controller does not provide additional current to the TRIAC dimmer using the sink current path. On the other hand, when the LED lamp current falls below the threshold current level, the LED controller increases the amount of bleeder current to maintain TRIAC conduction. Accordingly, during TRIAC conduction operating mode, the disclosed LED controller ensures that the TRIAC dimmer is not multi-firing by detecting a threshold current at which the TRIAC dimmer maintains conduction, and adaptively adjusting the current in the sink current path based on the sensed TRIAC dimmer current.

The disclosed embodiments include a controller for an LED lamp that adaptively adjusts the level of current applied to a LED lamp dimmer, such as a TRIAC dimmer, through a sink current path included in the dimmer controller in accordance with a sensed TRIAC dimmer current loading. Once the TRIAC dimmer is triggered, the controller regulates the current level, referred to as "bleeder current" through the additional current branch to maintain a threshold level, called a holding current. The LED controller sets the holding current level by sensing the TRIAC dimmer current loading to detect when the TRIAC dimmer stops conducting current or conducts insufficient current to remain on for an entire conduction cycle (i.e., multi-fires). The detected current level condition is stored as the TRIAC dimmer holding current level. The stored holding current level may be continually adjusted by sensing the TRIAC dimmer current loading at specified interval to accommodate changes in system operating conditions.

To adaptively adjust the current level applied to a TRIAC dimmer to maintain the holding current level during TRIAC conduction operating mode, the LED controller compares the sensed TRIAC dimmer current loading with the stored holding current threshold. If the sensed TRIAC dimmer current loading is greater than the stored holding current threshold, the LED controller reduces the level of additional current applied to a TRIAC dimmer through a sink current path included in the dimming controller to zero. In other words, when the LED lamp current is greater than the holding current sufficient for the TRIAC dimmer to maintain conduction, the LED controller turns off additional current applied to a TRIAC dimmer through the sink current path. If, on the other hand, the sensed TRIAC dimmer current loading is less than the stored holding current threshold, the LED controller supplies additional current to a TRIAC dimmer through the sink current path to a level equal to the stored holding current threshold.

Additionally, because the disclosed LED controller continually senses the TRIAC dimmer current, the LED controller can sense increased TRIAC dimmer current demands that occur after the TRIAC dimmer is trigger and supply the increased current demands using a single sink current path. As the operation of the TRIAC dimmer transitions to the reduced current demands of maintaining the dimmer holding current, the disclosed LED controller reduces the level of current supplied to the TRIAC dimmer through the sink current path from fully ON to OFF, in steps of 1% of the current level when the TRIAC dimmer is fully ON. Such a technique is beneficial because a single sink current path included in an LED controller is used to supply both heavy and light TRIAC dimmer current demands, while adaptively adjusting the current level in the sink current path based on the sensed current demands of the TRIAC dimmer.

By adaptively adjusting the level of current in the sink current path, the LED controller prevents the TRIAC dimmer current loading level from dropping below the stored holding current threshold. In turn, the LED controller reduces perceivable flickering of the LEDs throughout the dimming range, and causes the LED brightness to respond quickly and smoothly when the TRIAC dimmer switch is adjusted from a startup condition to an active condition.

The features and advantages described in the specification are not all inclusive and, in particular, many additional features and advantages will be apparent to one of ordinary skill in the art in view of the drawings and specification. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the present disclosure can be readily understood by considering the following detailed description in conjunction with the accompanying drawings.

DETAILED DESCRIPTION OF EMBODIMENTS

The Figures (FIG.) and the following description relate to embodiments of the present disclosure by way of illustration only. It should be noted that from the following discussion, alternative embodiments of the structures and methods disclosed herein will be readily recognized as viable alternatives that may be employed without departing from the principles of the present disclosure.

Reference will now be made in detail to several embodiments of the present disclosure, examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the embodiments of the disclosure described herein.

Figure 1:
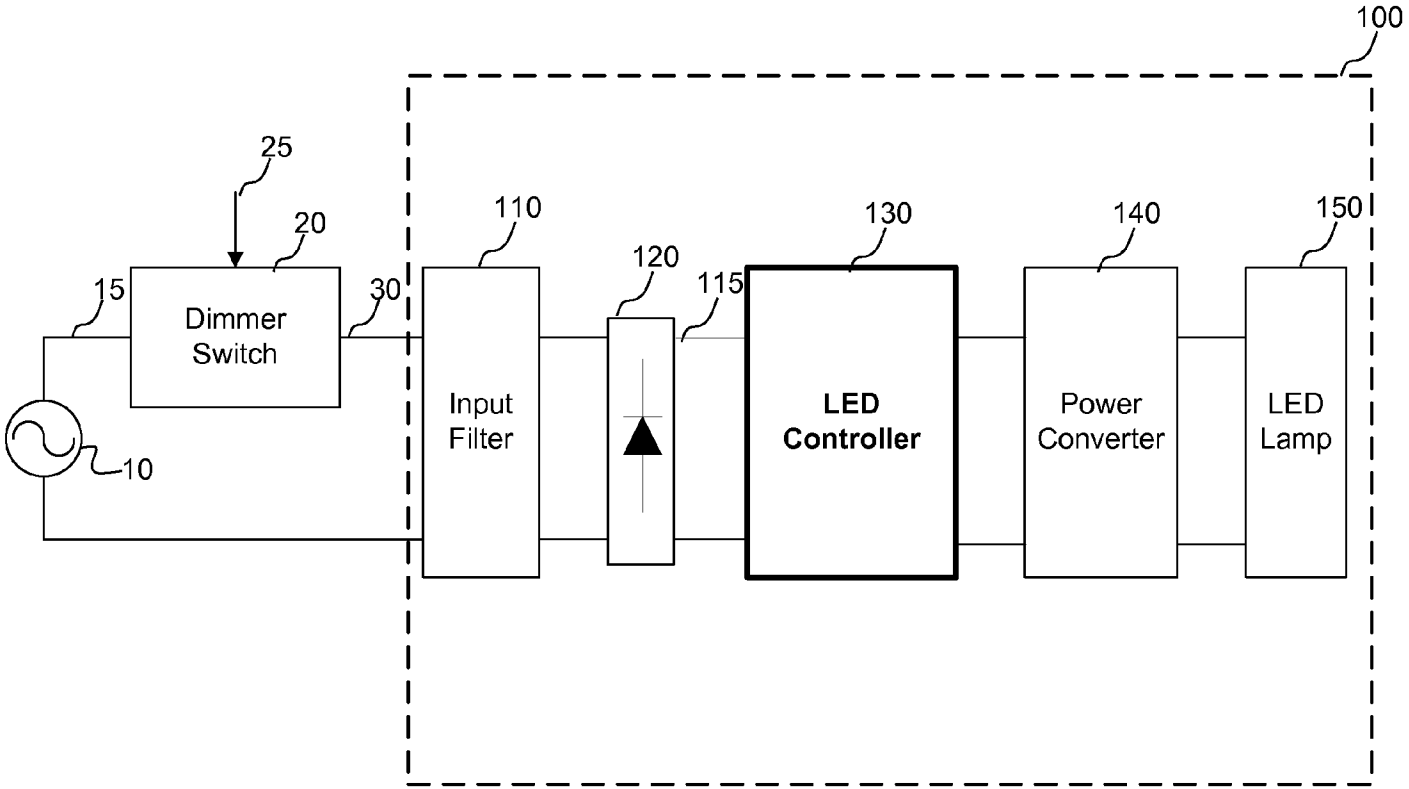
FIG. 1 is a circuit diagram illustrating an LED lamp system, according to one embodiment.

FIG. 1 is a circuit diagram illustrating an LED lamp system including an LED lamp circuit 100 used in conjunction with a dimmer switch 25 (e.g., a conventional dimmer switch). The LED lamp circuit 100 includes an LED lamp 150. According to various embodiments, the LED lamp 150 operates as a direct replacement of an incandescent lamp in a conventional dimmer switch setting. A dimmer switch 25 is coupled in series with an AC input voltage source 10 and the LED lamp circuit 100. The dimmer switch 25 controls the amount (i.e. intensity) of light output by the LED lamp 150 by phase modulating (e.g., via leading edge dimming or trailing edge dimming) an AC input voltage 15. In operation, the dimmer switch 25 receives the AC input voltage 15 and generates an output signal having an adjusted root mean square voltage (V-RMS) of the AC input voltage 15. The dimmer switch 25 determines the amount of adjustment applied to the AC input voltage 15 based on the value of a dimming input signal 20. In some implementations, the dimming input signal 20 is an analog signal produced by a knob, slider switch, or other suitable electrical or mechanical device capable of providing an adjustment signal with a variable range of adjustment settings. In other implementations, the dimming input signal 20 is a digital signal. The output signal of the dimmer switch 25 operates as a lamp input voltage 30 for the LED lamp circuit 100. The LED lamp circuit 100 adjusts the light output intensity of the LED lamp 150 proportionally to the value of the LED lamp circuit 100 lamp input voltage 30, exhibiting behavior similar to incandescent lamps.

One example of a dimmer switch is described in U.S. Pat. No. 7,936,132, which is incorporated by reference in its entirety. In one embodiment, the dimmer switch 25 employs phase angle switching to adjust the LED lamp circuit 100 lamp input voltage 30 by using a TRIAC circuit. A TRIAC is a bidirectional device that can conduct current in either direction when it is triggered, or turned on. Once triggered, the TRIAC dimmer continues to conduct until the current drops below a certain threshold, called a holding current. For the internal timing of a TRIAC dimmer to function properly, current is drawn from the TRIAC dimmer switch 25 in a regulated manner that provides a smooth transition in light intensity level output of the LED lamp circuit 100 without perceivable flicker.

The LED lamp circuit 100 controls dimming of LED lamps to achieve desired dimming based on the dimming input signal 20. The LED lamp circuit 100 adaptively controls dimming in a manner that reduces or eliminates perceivable flickering of the LEDs throughout the dimming range, and will cause the LED lamp brightness to respond quickly and smoothly when the TRIAC dimmer switch 25 is adjusted. In an embodiment, the LED lamp circuit 100 includes an input filter 110, a bridge rectifier 120, an LED controller 130, a power converter 140, and one or more LED lamps 150.

The input filter 110 filters the lamp input voltage 30 to reduce noise by limiting electromagnetic interference (EMI) and in-rush current. In one implementation, the input filter 110 is a resistor-inductor (RL) circuit. In other implementations, the input filter 110 includes one or a combination of other discrete circuit elements, and digital circuitry to limit EMI and instantaneous input current drawn by the LED lamp circuit 100 when LED lamp circuit 100 is turned on. The bridge rectifier 120 generates a rectified input voltage 115 from the filtered lamp input voltage 30. The power converter 140 comprises a transformer including a primary winding coupled to an input voltage and a secondary winding coupled to an output of the power converter 140. The power converter 140 also includes a switch coupled to the primary winding of the transformer. In operation, current through the primary winding of the power converter 140 is generated while the switch is turned on and is not generated while the switch is turned off. The power converter 140 further includes a controller configured to generate a control signal to turn on the switch responsive to the control signal being in a first state and to turn off the switch responsive to the control signal being in a second state. In one implementation, the states of the control signal include a logic "1" and a logic "0." In other implementations, the states of the control signal include at least two different analog signal levels.

The LED controller 130 regulates the output current provided to the power converter 140 to control the operation of the LED lamp 150. As previously described and as further described in conjunction with FIG. 2, the LED controller 130 senses the TRIAC dimmer current loading, which is equivalent to the current received by the power converter 140, compares the sensed TRIAC dimmer current loading with the stored holding current threshold, and adjusts the current level applied to the TRIAC dimmer 25 to maintain the holding current level of the TRIAC dimmer 25.

LED Controller

The LED controller 130 adaptively adjusts the level of current in the sink current path between the TRIAC dimmer 25 and the power converter 140 to regulate the TRIAC dimmer 25 current level under various operating conditions. For example, in a first operating mode, which occurs within several hundred microseconds after the TRIAC dimmer 25 is triggered, the TRIAC dimmer 25 loading current transitions from a heavy current level (e.g., in a range from 100-200 mA) to a light current level (e.g., 45 mA). While in a second operating mode, the TRIAC dimmer loading current is maintained at a level that meets or exceeds the holding current. To adapt to various operating conditions and system specifications, the LED controller 130 senses the TRIAC dimmer current loading signal 115, compares the value sensed TRIAC dimmer current loading signal 115 with the stored holding current of the TRIAC dimmer 25, and adjusts the TRIAC dimmer current loading signal 115 to prevent the TRIAC dimmer current loading level from dropping below the stored holding current threshold level as further described in conjunction with FIG. 2.

Figure 2:
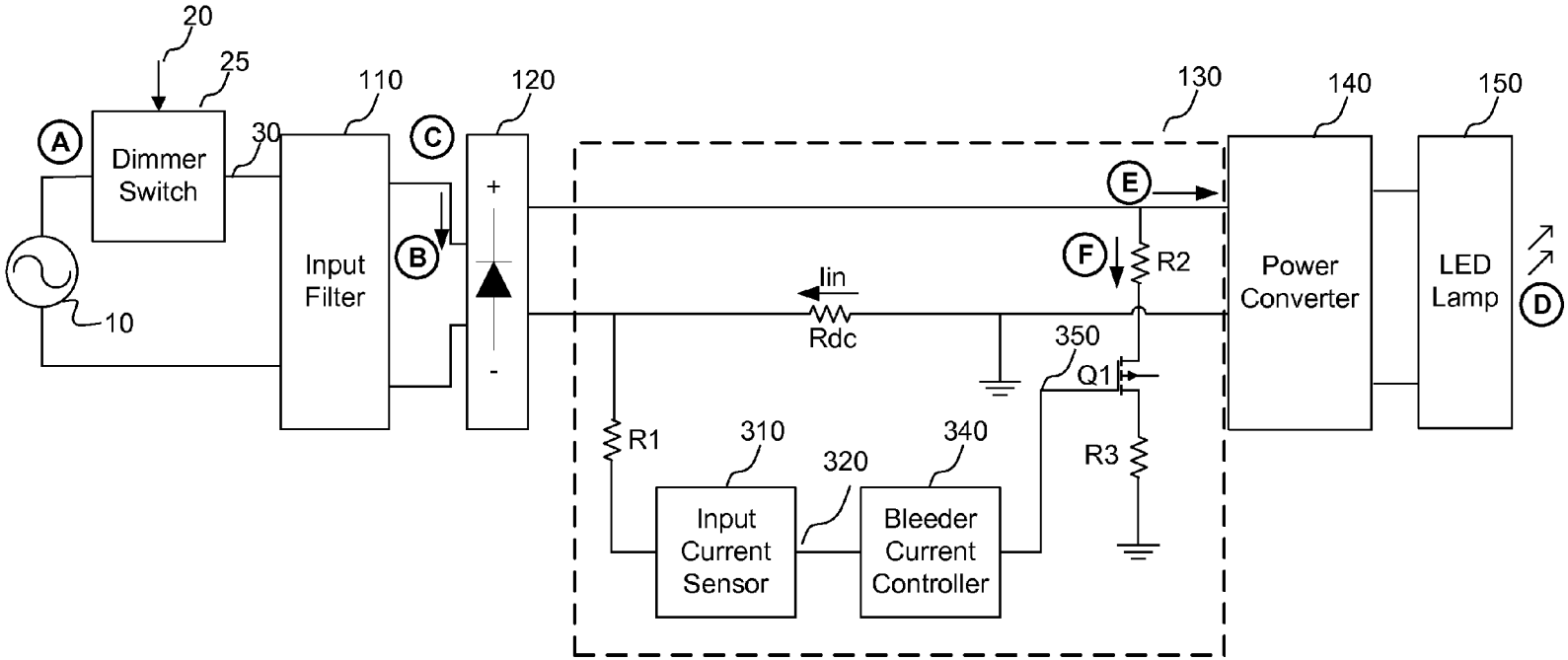
FIG. 2 is a circuit diagram illustrating an LED controller of the LED lamp system of FIG. 1, according to one embodiment.

FIG. 2 is a circuit diagram illustrating an exemplary LED controller 130 of the LED lamp circuit 100. The LED controller 130 includes an input current sensor 310, a bleeder current controller 340, and a sink current path formed by the switch Q1 and the resistors R2 and R3. As depicted in FIG. 2, the switch Q1 is a metal oxide field effect transistor (MOSFET) having a source terminal coupled to the resistor R3, a drain terminal coupled to the resistor R2, and a gate terminal coupled to the output signal 350 from the bleeder current controller 340. While a MOSFET switch Q1 is used as the power switch in the embodiment shown FIG. 2, a BJT (bipolar junction transistor) may also be used as the power switch for regulating the current conducted the sink current path according to other embodiments herein.

The input current sensor 310 senses the input current to power converter 140, and provides the output signal 320, which corresponds to the sensed input current. The bleeder current controller 340 receives the output signal 320 and outputs a control signal 350 for regulating the level of current applied to the TRIAC dimmer 25 using the sink current path included in LED controller 310. The output signal 320 is a voltage signal that corresponds to the voltage across the sense resistor Rdc. The voltage across the sense resistor Rdc is a function of the input current to the power converter 140, labeled "E" in FIG. 2. The input current to the power converter 140 includes the line current conducted by the TRIAC dimmer 25, labeled "B", and the current conducted through the sink current path (herein after referred to as "bleeder current"), labeled "F." The sense resistor Rdc is coupled to receive the return line current, which is equivalent to the sum of the input current to the power converter 140 and the sink path current because of the current loop formed by the AC signal source 10 and the LED lamp 150. The sense resistor Rdc converts the AC line current (i.e., the TRIAC dimmer current) to a voltage signal corresponding to the sensed level of the TRIAC dimmer current. The sense resistor Rdc is further coupled to the negative terminal of the bridge rectifier 120 and the resistor R1. The resistor R1 is further coupled to the input of the input current sensor 310 to form a resistor network used by the input current sensor 310 to amplify the sensed voltage as further described in conjunction with FIG. 3.

The LED controller 130 further includes a bleeder current controller 340 configured to receive the output signal 320 from the input current sensor 310 and generate an output control signal 350. The control signal 350 controls the operation of the switch Q1 to regulate the amount of current conducted by the bleeder current path. In one embodiment, the bleeder current controller 340 receives the analog output signal 320 from the input sensor 310 and converts the received analog signal to a digital signal for processing by a dimming controller included in the bleeder current controller 340 as further described in conjunction with FIG. 5. In processing the received analog output signal 320, the bleeder current controller 340 compares the sensed TRIAC dimmer current with a detected or otherwise stored value of the holding current of the TRIAC dimmer 25. In some embodiments, to perform the comparison, the bleeder current controller 340 uses the received analog output signal 320 as a proxy for the sensed TRIAC dimmer current. Because the analog output signal 320 is an amplified representation of the sensed TRIAC dimmer current, the bleeder current controller 340 may compare, with increased measurement accuracy and resolution, relatively small levels of TRIAC dimmer current with a reference holding current. The output signal 350 of the bleeder current controller 340 may be a waveform suitable to control the ON and OFF state of the switch Q1 to regulate the current level conducted by the bleeder current path. For example, the bleeder current controller 340 may adjust the duty cycle of the output signal 350 to correspond to a level of adjustment applied the bleeder current path based on the sensed current of the TRIAC dimmer 25. The duty cycle refers to the fraction (often expressed as a percentage) of the switching period during which the switch Q1 is turned ON. In some embodiments, the bleeder current controller 340 adjusts the duty cycle incrementally with a resolution of 1% of the adjustment range.

In some embodiments, the bleeder current controller 340 includes storage elements (e.g., one or a combination of volatile or nonvolatile memory elements) to store calibration settings, holding current settings, or other parameters for the operation of the LED system 100. For example, the bleeder current controller 340 may store holding current of the TRIAC dimmer 25 detected, during a calibration process, by the input current sensor 310.

The holding current level may vary between TRIAC dimmer devices. Accordingly, in some embodiments, the LED controller 130 may perform a calibration process to detect the holding current for the TRIAC dimmer 25. For example, during a calibration process, the LED controller 130 senses the TRIAC dimmer current loading when the TRIAC dimmer 25 turns off or multi-fires, and outputs the sensed current level to bleeder current controller 340, where the sensed current level is stored as the holding current level reference. By detecting the holding current level, the LED controller 130 can effective regulate a variety of TRIAC dimmers used in different types of operating conditions without the need to be preprogrammed with the holding current level parameters for the particular TRIAC dimmer.

In one embodiment, the holding current level reference may be changed by performing a subsequent sensing of the TRIAC dimmer current loading when the TRIAC dimmer turns off. In some embodiments, LED controller 130 initiates sensing responsive to a change in operating conditions, such as a change in temperature. In other embodiments, LED controller 130 initiates sensing of the TRIAC dimmer current loading when the TRIAC dimmer 25 turns off periodically, such as after a specified or calculated period of time or interval. Such a calibration scheme is beneficial because it uses a sensed value of the holding current for a particular TRIAC dimmer to apply the minimum level of bleeder current to the TRIAC dimmer 25 to sustain its conduction. In another embodiment, the holding current level reference may be provided to the LED controller 130 by a source external to the LED controller 130, or may be adjusted based on other system parameters, such as semiconductor manufacturing process parameters or temperature parameters.

Figure 3:
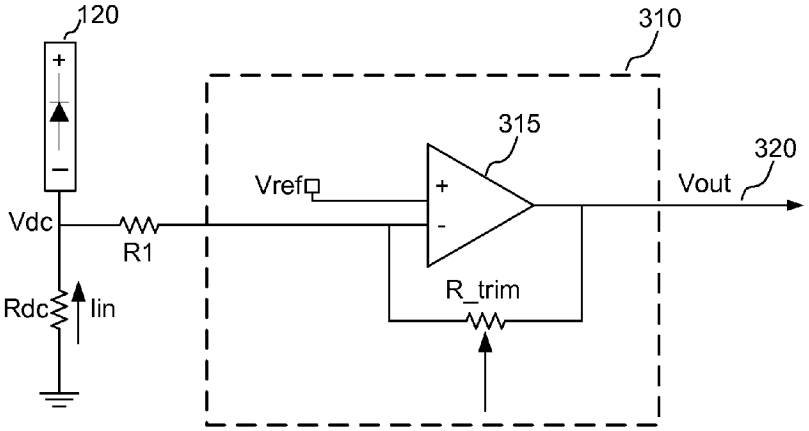
FIG. 3 is a circuit diagram illustrating an input current sensor of the LED lamp system of FIG. 1, according to one embodiment.

FIG. 3 is a circuit diagram illustrating an exemplary input current sensor 310 of the LED lamp system of FIG. 1. In one embodiment, the input current sensor 310 includes an operational amplifier 315 having a non-inverting terminal coupled to a reference voltage Vref and an inverting terminal coupled to an external resistor R1, and a feedback resistor R_trim coupled between the inverting terminal and the output of operational amplifier 315. Other embodiments of the input current sensor 310 may include alternative or additional components configured to amplify a voltage signal corresponding to the sensed TRIAC dimmer current to generate a corresponding amplified sensed voltage signal. The operational amplifier 315 may be configured to have a bandwidth suitable to sense rapid changes in the TRIAC dimmer current loading. For example, in one embodiment the operational amplifier 315 has a bandwidth in a range of 300 kHz to 500 kHz, or other range suitable to adjust to changes in the sensed TRIAC dimmer current loading and filter switching noise associated with the LED driver. As shown in FIG. 3, the external resistor R1, the feedback resistor R_trim, and the operational amplifier 315 are arranged to inversely amplify the voltage Vdc to generate amplified output voltage Vout 320. In one example, Vout 320 is determined in accordance with the following equation:

$$Vout=G*Vdc+(1+G)Vref \quad (1)$$

where G represents any integer, Vdc represents the voltage across the sense resistor Rdc, and Vref represents the voltage of the reference voltage applied to the non-inverting terminal of the operational amplifier 315. The feedback resistor R_trim may be a programmable resistive element, such as a digital potentiometer with sufficient impedance range and resolution to match the resistance of the external resistor R1. Also, the resistance value of the feedback resistor R_trim may be adjusted by the LED controller 130 during calibration to adjust the value of the holding current level for different TRIAC dimmers by adjusting the ratio of R1 to R_trim. Further, the LED controller 130 may share the trim values used to adjust the impedance value of the feedback resistor R_trim with other trimmed resistors included in the reference generating circuit that generates the reference signal Vref.

Because the output of the operational amplifier 315 generates a positive voltage, the reference signal Vref may be a positive voltage. Such a configuration is beneficial because the current conducted by the TRIAC dimmer 25 is negative, which in turn causes the voltage across the sense resistor Rdc to be a negative voltage; a negative voltage may be challenging to measure directly for a single polarity power supply system. The amplified output Vout 320 of the operational amplifier 315 is coupled to the input of the bleeder current controller 340.

Figure 4:
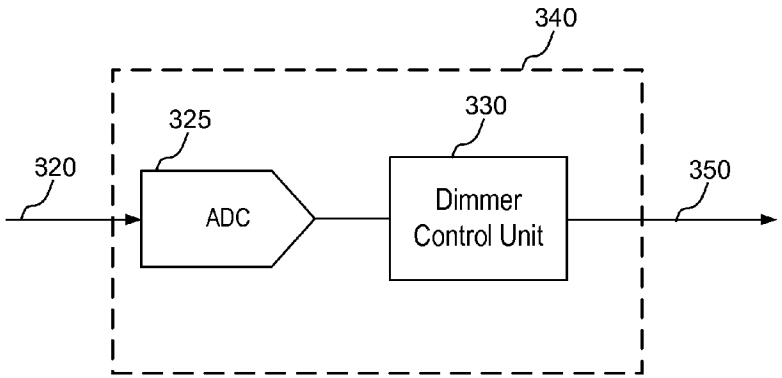
FIG. 4 is a circuit diagram illustrating a bleeder current controller of the LED lamp system of FIG. 1, according to one embodiment.

FIG. 4 is a circuit diagram illustrating an exemplary bleeder current controller 340 of the LED lamp system of FIG. 1. In one embodiment, the bleeder current controller 340 includes an analog-to-digital converter (ADC) 325 configured to convert the amplified output Vout 320 of the operational amplifier 315 to a corresponding digital signal. The output of the ADC 325 is coupled to the input of the dimmer control unit 330. In one embodiment, the dimmer control unit 330 converts the value of the digitized representation of the amplified sensed voltage Vdc to a value corresponding to the sensed TRIAC dimmer current loading and compares the calculated sensed TRIAC dimmer current loading value to the stored TRIAC holding current. If the sensed TRIAC dimmer current loading value is less than the stored TRIAC holding current, the dimmer control unit 330 will generate an output signal 350 having a duty cycle sufficient to adjust the bleeder current to a value corresponding to difference between the stored TRIAC holding current and the sensed TRIAC dimmer current loading. In other words, if sensed TRIAC dimmer current loading is less that stored holding current, the dimmer control unit 330 supplies the minimum amount of current to the bleeder current path so the TRIAC dimmer current loading will not drop below the stored holding current value. If, on the other hand, the sensed TRIAC dimmer current loading value is greater than the stored TRIAC dimmer holding current, the dimmer control unit 330 turns off the bleeder current path.

Figure 5A:
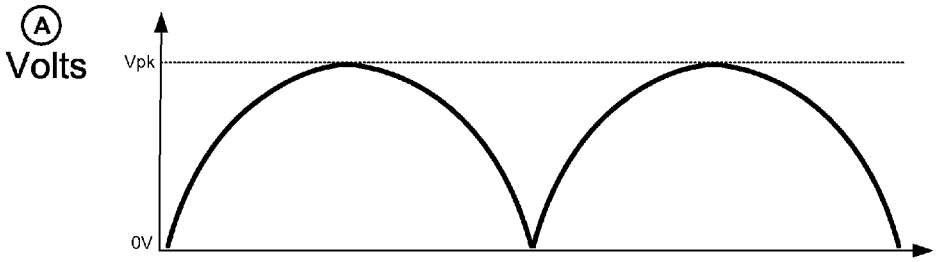
FIG. 5A illustrates an example voltage waveform produced by a voltage source of the LED lamp system of FIG. 2, according to one embodiment.
Figure 5B:
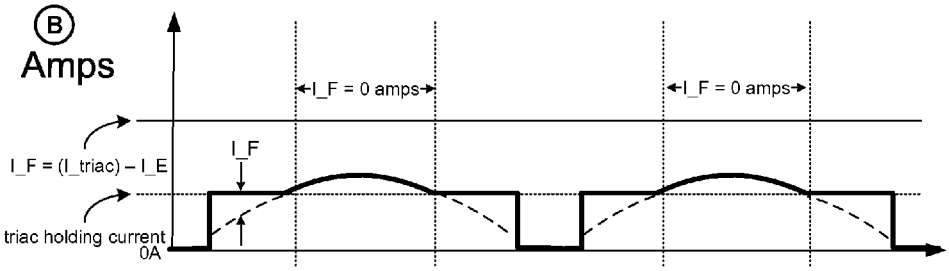
FIG. 5B illustrates an example waveform representing the current produced by a dimming switch of the LED lamp system of FIG. 2, according to one embodiment.

FIGS. 5A-5D illustrate example waveforms of the LED lamp system of FIG. 2. FIG. 5A illustrates an example voltage waveform representing an AC input voltage signal 15 produced by the AC input voltage source 10. FIG. 5B illustrates an example waveform representing the current I_B (TRIAC current) produced by a TRIAC dimmer 25 of the LED lamp circuit of FIG. 2, according to one embodiment. As shown in FIG. 2, the TRIAC holding current varies from TRIAC to TRIAC, but is detected by LED controller 130 for use a reference for comparison as previously discussed in conjunction with FIG. 2. The value of the TRIAC dimmer current loading I_E is equivalent to the sum of the TRIAC dimmer current I_B and the bleeder current I_F. When the value of the TRIAC dimmer current I_B value is less than the TRIAC holding current, the LED controller 130 increases the bleeder current I_F by an amount equivalent to the difference between the TRIAC holding current and the sensed TRIAC dimmer current loading until the value of the sensed TRIAC dimmer current loading equals the value of the TRIAC holding current value. When the value of the TRIAC dimmer current loading I_E exceeds the value of the TRIAC holding current, the LED controller 130 turns off the bleeder current I_F because the sensed TRIAC dimmer current loading is sufficient to meet the value of the TRIAC dimmer current loading I_E needed to illuminate LED lamp 150. In other words, as shown in FIG. 5B, the LED controller 130 applies a minimum amount of bleeder current to sustain the TRIAC holding current when the TRIAC dimmer current loading I_E demands exceed the current level of the sensed TRIAC dimmer current I_B. And because the TRIAC dimmer current loading is continually sensed at a relatively high interval (e.g., a range from 300 kHz to 500 kHz), the LED controller 130 may quickly adjust the level of bleeder current. To provide a smooth adjustment of the bleeder current, the LED controller 130 may perform the adjustment of the value of the bleeder current I_F with a resolution of 1% of the total adjustment range or integer multiples thereof.

Figure 5C:
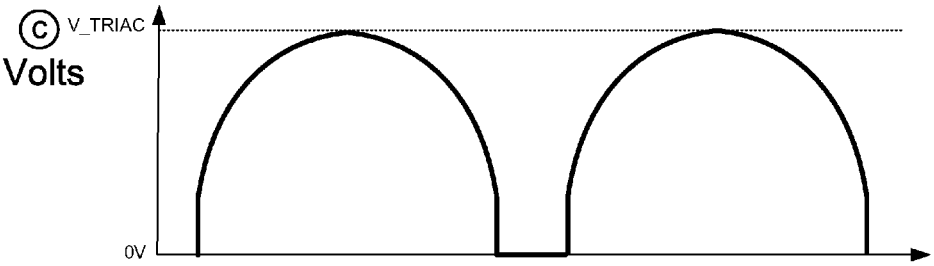
FIG. 5C illustrates an example waveform representing the voltage produced by a dimming switch of the LED lamp system of FIG. 2, according to one embodiment.
Figure 5D:
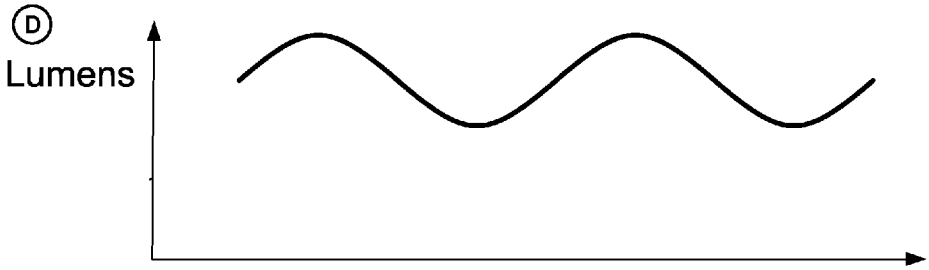
FIG. 5D illustrates an example waveform representing a measure of visible light emitted by the LED lamp of the of the LED lamp system of FIG. 2, according to one embodiment.

FIG. 5C illustrates an example waveform representing the voltage produced by a TRIAC dimmer 25 of the LED lamp system 100 of FIG. 2. As shown in FIG. 5C, the voltage output by the TRIAC dimmer 25 generally tracks the voltage waveform representing the AC input voltage signal 15. FIG. 5D illustrates an example waveform representing a measure of visible light emitted by the LED lamp 150 of the of the LED lamp system 100 of FIG. 2. As shown in FIG. 5D, the output level of LED lamp 150 resembles a sine wave phase shifted from the input voltage applied to the TRIAC dimmer 25.

Figure 6:
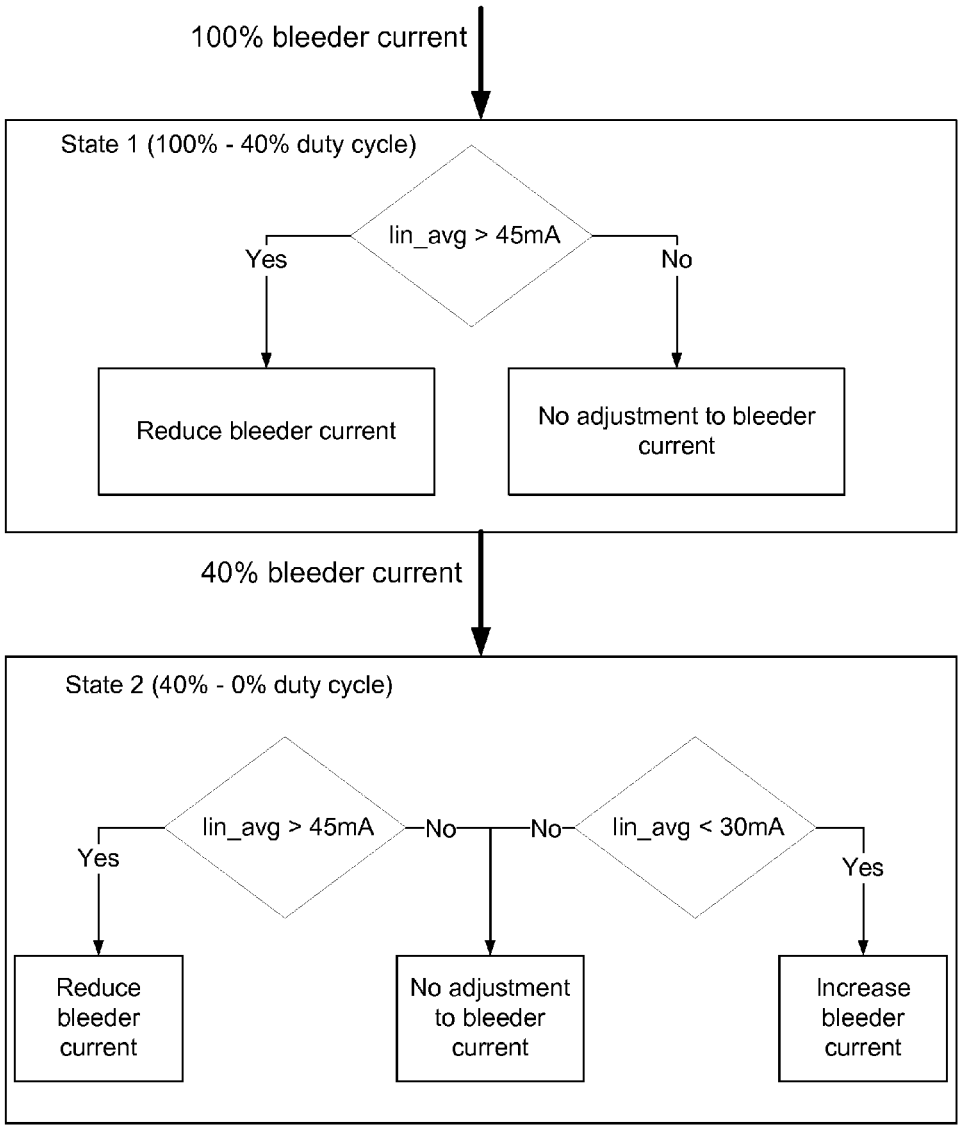
FIG. 6 is flow chart illustrating a method for regulating the bleeder current by the LED controller of LED lamp system of FIG. 2, according to one embodiment.

FIG. 6 is flow chart illustrating a method for regulating the bleeder current by the LED controller 130 of LED lamp circuit of FIG. 2. As shown in FIG. 6, to ensure smooth transition from a heavy TRIAC dimmer current loading to lighter load demands, the bleeder current controller 340 detects the sensed TRIAC dimmer current and incrementally adjusts the amount of current supplied to the TRIAC dimmer 25 using the bleeder current path responsive to the sensed TRIAC dimmer current loading value. During conditions shortly (e.g., 400 us) following the triggering of the TRIAC dimmer 25, the sensed TRIAC dimmer current loading value is zero amps. The LED controller 130 senses low current and fully turns on the bleeder current by adjusting the output signal 350 to 100% duty cycle to supply sufficient turn-on current (i.e. current level equal to the holding current with a suitable margin) to cause the TRIAC dimmer 25 to conduct current. As the current load of the TRIAC dimmer 25 decreases, the LED controller 130 continually senses the TRIAC dimmer current loading and incrementally decreases the bleeder current if the sensed TRIAC dimmer current loading value is greater than the stored holding current value. For example, as shown in stage 1 of FIG. 6, the LED controller 130 continually (e.g., at a specified or calculated interval, such as at sample rate of at least double the bandwidth of the operational amplifier 315) compares the sensed TRIAC dimmer current loading with the stored holding current value of 45 mA. As previously discussed in conjunction with FIGS. 3 and 4, the TRIAC dimmer current loading may be sensed at rate ranging, for example, from 300 kHz to 500 kHz, corresponding to the bandwidth of the operational amplifier 315. Corresponding adjustments to the bleeder current may be made in increments of 1% of the total adjustment range. Returning to FIG. 6, in stage 1, the bleeder current may be reduced in 1% increments until the level of the sensed TRIAC dimmer current loading reaches the value of the stored holding current. In the example shown in FIG. 6, in stage 1 the LED controller 130 operates in a dimmer trigger operating mode. At the beginning of the dimmer trigger operating mode, the input voltage of the TRIAC dimmer 25 is very low, and the duty cycle of the control signal is set to 100%, causing the switch to be fully on. As the current to maintain the LED lamp 150 increases in stage 1, the LED controller 130 adjusts the duty cycle of the output signal 350 applied to switch Q1 from 100% to 40% to reduce the amount of bleeder current supplied to the TRIAC dimmer 25 through the sink current path. When the LED controller 130 determines that the sensed TRIAC dimmer current is equal to the holding current, within specified tolerance range, the LED controller 130 transitions to a triggering conduction mode in stage 2.

In stage 2, the LED controller 130 seeks to maintain the sensed TRIAC dimmer current loading at the holding current level by incrementally adjusting the value of the bleeder current to ensure that sensed current is maintained at value substantially equal to the holding current. For example, as shown in stage 2 of FIG. 6, the LED controller 130 is configured to maintain the sensed TRIAC dimmer current loading in a range between 30 mA and 45 mA. During holding current optimization, the LED controller 130 increases and decreases the bleeder current in a manner similar to that described with respect to stage 1.

By dynamically adjusting the bleeder current based on the an accurate measure of the sensed TRIAC dimmer input current loading, the disclosed embodiments provide a sufficient amount of current to sustain the operation of a TRIAC dimmer during current loading and holding current optimization modes. Also, because the bleeder current may be adjusted with high resolution (e.g., 1% of the total adjustment range of the bleeder current), the disclosed embodiments enable a smooth transition between operating modes to maintain to the TRIAC dimmer performance during these transitions. And further, because the TRIAC dimmer current loading is continually sensed, the disclosed embodiments can minimize power loss resulting from applying excessive bleeder current.

Upon reading this disclosure, those of skill in the art will appreciate still additional alternative designs for controlling dimming of an LED lamp using an adaptive holding current adjustment. Thus, while particular embodiments and applications of the present disclosure have been illustrated and described, it is to be understood that the disclosure is not limited to the precise construction and components disclosed herein and that various modifications, changes and variations which will be apparent to those skilled in the art may be made in the arrangement, operation and details of the method and apparatus of the present disclosure disclosed herein without departing from the spirit and scope of the disclosure.

What is claimed is:

1. A light emitting diode (LED) controller comprising:

a current sensor coupled to a dimmer, the current sensor configured to detect a dimmer current;

a current controller coupled to an output of the current sensor, the current controller comprising a dimmer control unit configured to:

determine a dimmer operating mode based on the detected dimmer current, wherein a first dimmer operating mode corresponds to conditions at the beginning of operation after the dimmer is triggered and a second dimmer operating mode corresponds to conditions that the detected dimmer current is maintained within a predetermined tolerance range of a threshold dimmer current, compare the detected dimmer current to a threshold dimmer current value, and generate a control signal during the first dimmer operating mode and during the second dimmer operating mode for regulating the dimmer current based at least in part on a difference between the threshold current value and the detected dimmer current, and the determined dimmer operating mode; and a switch coupled to the current controller, the switch configured to receive the control signal generated by the dimmer control unit and regulate an amount of additional dimmer current to be supplied to the dimmer through an additional current path based on the control signal, the amount of additional current supplied to the dimmer based on the difference between the threshold dimmer current value and the detected dimmer current.

2. The LED controller of claim 1, wherein the current controller adjusts a duty cycle of the control signal based on the determined dimmer operating mode to regulate the amount of additional dimmer current to be supplied to the dimmer through the additional current path.

3. The LED controller of claim 2, wherein during the first dimmer operating mode, the current controller adjusts the duty cycle of the control signal between a range of one hundred percent and forty percent based on the difference between the detected dimmer current and the threshold dimmer current.

4. The LED controller of claim 2, wherein during the second dimmer operating mode, the current controller adjusts the duty cycle of the control signal between a range from forty percent to zero percent based on the difference between the detected dimmer current and the threshold dimmer current.

5. The LED controller of claim 1, wherein the threshold dimmer current value is based on a value of the dimmer current when the dimmer stops conducting after being triggered.

6. The LED controller of claim 1, wherein the threshold dimmer current value is based on a value of a programmable circuit element, the value of the programmable element being accessible by the LED controller.

7. The LED controller of claim 6, wherein the programmable circuit element comprises a resistive circuit element.

8. The LED controller of claim 1, wherein the additional dimmer current is equal to the difference between the threshold dimmer current value and the detected dimmer input current.

9. The LED controller of claim 1, wherein the dimmer control unit is further configured to determine when to transition from the first dimmer operating mode to the second dimmer operating mode, wherein in the case of the first dimmer operating mode, the current controller transitions from the first dimmer operating mode to the second dimmer operating mode when the current controller determines that the detected dimmer current is equal to the threshold dimmer current within the predetermined tolerance range.

10. A method of controlling dimming of an LED lamp, the method comprising:

detecting, by a current sensor, a dimmer current;

determining, by a dimmer control unit, a dimmer operating mode based on the detected dimmer current, wherein a first determined dimmer operating mode corresponds to conditions at the beginning of operation after the dimmer is triggered and a second determined dimmer operating mode corresponds to conditions when the detected dimmer current is maintained within a predetermined tolerance range of the threshold dimmer current;

comparing the detected dimmer current to a threshold dimmer current value;

generating a control signal during the first dimmer operating mode and during the second dimmer operating mode to regulate the dimmer current based at least in part on a difference between the threshold current value and the detected dimmer current and the determined dimmer operating mode; and regulating an amount of additional dimmer current to be supplied to the dimmer through an additional current path based on a duty cycle of the control signal, the amount of additional current supplied to the dimmer through the additional current path based on the difference between the threshold dimmer current value and the detected dimmer current.

11. The method of claim 10, further comprising adjusting the duty cycle of the control signal based on the determined dimmer operating mode to regulate the amount of additional dimmer input current to be supplied to the dimmer through the additional current path.

12. The method of claim 10, further comprising, during the first dimmer operating mode, modifying the control signal by adjusting the duty cycle of the control signal between a range of one hundred percent and forty percent based on the difference between the detected dimmer current and the threshold dimmer current.

13. The method of claim 12, further comprising, during the first dimmer operating mode, regulating the amount of additional dimmer current to be supplied to the dimmer through the additional current path based on the modified control signal.

14. The method of claim 13, further comprising, generating the modified control signal to turn on and to turn off a switch to regulate the amount of additional dimmer current to be supplied to the dimmer through the additional current path based on the modified control signal.

15. The method of claim 10, further comprising, during the second dimmer operating mode, modifying the control signal by adjusting the duty cycle of the control signal between a range from forty percent to zero percent based on the difference between the detected dimmer current and the threshold dimmer current.

16. The method of claim 15, further comprising, during the second dimmer operating mode, regulating the amount of additional dimmer current to be supplied to the dimmer through the additional current path based on the modified control signal.

17. The method of claim 16, further comprising generating the modified control signal to turn on and to turn off a switch to regulate the amount of additional dimmer current to be supplied to the dimmer through the additional current path based on the modified control signal.

18. The method of claim 10, further comprising:

determining a value of the dimmer current when the dimmer stops conducting after being triggered; and modifying the threshold dimmer current based on the determined value of the dimmer current when the dimmer stops conducting after being triggered.

19. The method of claim 10, wherein the threshold dimmer current value is based on a value of a programmable circuit element, the value of the programmable element being accessible by the LED controller.

20. The method of claim 19, wherein the programmable circuit element comprises a resistive circuit element.

21. The method of claim 10, wherein detecting the dimmer current comprise sensing the dimmer current at a specified interval.

22. The method of claim 10, further comprising determining when to transition from the first dimmer operating mode to the second dimmer operating mode, wherein in the case of the first dimmer operating mode, transitioning from the first dimmer operating mode to the second dimmer operating mode responsive to a determination that the detected dimmer current is equal to the threshold dimmer current within the predetermined tolerance range.

* * * * *